US009004547B2

(12) United States Patent
Thomas

(10) Patent No.: US 9,004,547 B2
(45) Date of Patent: Apr. 14, 2015

(54) FIXING DEVICE FOR A CLOSING ELEMENT

(76) Inventor: Werner Thomas, Asbach (DE)

( * ) Notice: Subject to any disclaimer, the term of this patent is extended or adjusted under 35 U.S.C. 154(b) by 500 days.

(21) Appl. No.: 13/312,027

(22) Filed: Dec. 6, 2011

(65) Prior Publication Data

US 2012/0153640 A1 Jun. 21, 2012

(30) Foreign Application Priority Data

Dec. 6, 2010 (DE) ..... 10 2010 062 452

(51) Int. Cl.

| | |
|---|---|
| ***E05C 19/10*** | (2006.01) |
| ***E05B 15/02*** | (2006.01) |
| ***E05B 15/00*** | (2006.01) |
| ***E05B 51/02*** | (2006.01) |
| ***E05C 3/00*** | (2006.01) |
| ***E05F 15/08*** | (2006.01) |
| ***E05B 77/42*** | (2014.01) |
| ***E06B 9/02*** | (2006.01) |
| *E05C 3/06* | (2006.01) |
| *E05C 3/16* | (2006.01) |
| *E05B 63/00* | (2006.01) |
| *E05B 65/00* | (2006.01) |
| *E06B 9/00* | (2006.01) |

(52) U.S. Cl.

CPC ..... *E05B 15/029* (2013.01); *E05B 15/0006* (2013.01); *E05B 51/02* (2013.01); *E05B 63/0052* (2013.01); *E05B 65/0021* (2013.01); *E05C 3/004* (2013.01); *E05C 3/006* (2013.01); *E05F 15/083* (2013.01); *E06B 2009/007* (2013.01); *E05Y 2900/148* (2013.01); *E05Y 2900/132* (2013.01); *E05B 77/42* (2013.01); *E06B 9/02* (2013.01)

(58) Field of Classification Search

CPC ..... E05B 15/00
USPC ..... 292/96, 101, 194, 195, 198, 201, 216, 292/95, 24, 32, DIG. 36, DIG. 32, DIG. 20, 292/DIG. 35, DIG. 47; 70/89, 90; 49/449
See application file for complete search history.

(56) References Cited

U.S. PATENT DOCUMENTS

| | | | | |
|---|---|---|---|---|
| 1,185,422 | A | 5/1916 | Mammelli | |
| 2,555,705 | A * | 6/1951 | Schafer | 220/348 |
| 2,722,469 | A * | 11/1955 | Kosovsky | 312/310 |
| 2,883,225 | A * | 4/1959 | Akehurst | 292/35 |

(Continued)

FOREIGN PATENT DOCUMENTS

| | | |
|---|---|---|
| DE | 76 05 029 U | 7/1976 |
| DE | 40 24 467 A1 | 2/1992 |

(Continued)

*Primary Examiner* — Kristina Fulton
*Assistant Examiner* — Faria Ahmad
(74) *Attorney, Agent, or Firm* — Muncy, Geissler, Olds & Lowe, P.C.

(57) ABSTRACT

The invention relates to a fixing device for a vertically movable closing element (1) for the at least partial closing of an opening (2) of a room.

Figure 1:
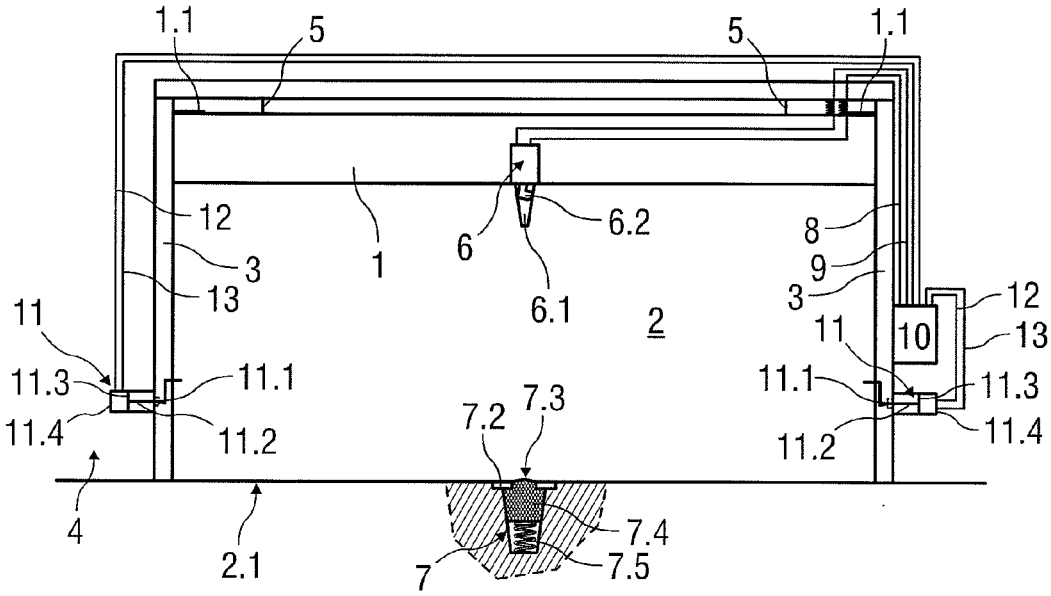

According to the invention, the fixing device for fixing of the closing element (1) in a closed state comprises at least one first fixing unit (6), arranged on the closing element (1), and an engaging unit (7), corresponding to the first fixing unit (6), in an opening bottom (2.1) and at least one second fixing unit (11), which is arranged on a guide (3), arranged to the side of the opening (2), for the closing element (1) and has a tensioning hook (11.1), which in the closed state of the closing element (1) can be latched in the closing element (1) in the area of an upper side of the closing element (1).

15 Claims, 1 Drawing Sheet

(56) References Cited

U.S. PATENT DOCUMENTS

| | | | | | |
|---|---|---|---|---|---|
| 3,044,841 | A | * | 7/1962 | William | 312/139.1 |
| 3,135,105 | A | * | 6/1964 | Leo | 70/71 |
| 3,785,187 | A | * | 1/1974 | Wolz | 70/264 |
| 3,795,010 | A | | 2/1974 | Ring | |
| 3,796,010 | A | | 3/1974 | Carlson | |
| 4,225,164 | A | * | 9/1980 | Wensley et al. | 292/33 |
| 5,183,177 | A | * | 2/1993 | Yu | 220/523 |
| 5,193,726 | A | * | 3/1993 | Humphrey | 225/4 |
| 5,203,392 | A | * | 4/1993 | Shea | 160/7 |
| 5,320,244 | A | * | 6/1994 | Yu | 220/507 |
| 5,975,329 | A | * | 11/1999 | Schmitt | 220/350 |
| 5,992,907 | A | * | 11/1999 | Sheldon et al. | 292/34 |
| 6,123,134 | A | * | 9/2000 | Thomas et al. | 160/8 |
| 6,540,268 | B2 | * | 4/2003 | Pauser | 292/48 |
| 7,070,215 | B2 | * | 7/2006 | Kelley et al. | 292/241 |
| 7,086,511 | B2 | * | 8/2006 | Morszeck et al. | 190/122 |
| 7,152,889 | B2 | * | 12/2006 | Jeffries | 292/215 |
| 7,490,873 | B1 | * | 2/2009 | Ricke et al. | 292/5 |
| 2005/0056387 | A1 | | 3/2005 | Fletcher | |

FOREIGN PATENT DOCUMENTS

| | | | |
|---|---|---|---|
| DE | 94 02 384 | | 6/1995 |
| DE | 295 08 533 | U1 | 10/1995 |
| DE | 195 17 241 | A1 | 2/1996 |
| DE | 102 38 815 | B3 | 2/2004 |
| DE | 20 2010 010 297 | U1 | 10/2010 |
| GB | 668560 | | 3/1952 |
| WO | WO 2010/114891 | A1 | 10/2010 |

* cited by examiner

FIXING DEVICE FOR A CLOSING ELEMENT

The invention relates to a fixing device for a vertically movable closing element according to the features of the preamble of claim 1.

This nonprovisional application claims priority under 35 U.S.C. §119(a) to German Patent Application No. DE 10 2010 062 452.7, which was filed in Germany on Dec. 6, 2010, and which is herein incorporated by reference.

A device for closing a room is known from the state of the art, as described in DE 40 24 467 A1. The device has a bulkhead which is guided in guides and is transverse to an opening and in the state of closing is sealed liquid-tight against the boundaries of the opening by at least one seal and in normal operation, leaving the opening free, is arranged above said opening. This bulkhead is moved vertically in the guides of a drive. In the upper area or above the opening, a changeover device is provided, which redirects the bulkhead to its arrangement for normal operation from the vertical position to an inclined position.

DE 76 05 029 U describes a safety bulkhead. The safety bulkhead for doors or the like for protection against flooding comprises lower and horizontal vertical guides with a U-shaped profile and two side vertical guides with a U-shaped profile for a buckling-resistant hollow bulkhead, deflection pulleys arranged at the upper end of the vertical guide for connecting means acting at one end at the hollow bulkhead and bearing counterweights at the other end, and sealing elements sealing the side and horizontal bulkhead edges in the U-guides.

A retention barrier for the liquid-tight closing of door and building openings is known from DE 295 08 533 U1. The retention barrier has a barrier body, placeable sealingly on the bottom area of the opening, and a receiving body cooperating with the side end sections thereof and arranged at the edges of the opening. The barrier body is made hollow and in the case of an accident can be filled with a liquid. Furthermore, the barrier body is guided movably in the perpendicular direction in rails arranged vertically on both of its sides between a raised position in the upper area of the opening and a locking position in the bottom area and is connected to at least one counterweight keeping it balanced in the empty state.

U.S. Pat. No. 1,185,422 A discloses a window latch for a vertically slidable window. The window latch comprises a hook part arranged on a lower frame section of the slidable window and an engaging catch member, formed on a window sill, for the hook part.

DE 102 38 815 B3 discloses a centering clamp for the centered fixing of a workpiece to be worked on. The centering clamp consists of a tensioning hook and a centering pin, arranged above it and seated on an adapter plate, with an engagement slot for the tensioning hook. The engagement slot for the centering pin is designed closed on the side facing away from the hook. On the other side, a slot cover slider, which follows the adjustment movement of a hook arm, is assigned to a hook arm of the tensioning hook.

DE 94 02 384 U1 discloses a removable flood protection system. For the side sealing of a protective plate by means of foam, two guide rails for receiving the seal are attached at the outer edge of the protective plate, which extends beyond the internal dimension of the area to be covered. The protective plate is mounted by means of tensioning hooks and counter supports, which are connected to a pull rope.

A flood panel assembly for access openings of a building is known from U.S. Pat. No. 3,796,010 A. The assembly comprises a frame, which is attached to the access opening, and a flood panel which can be arranged in the frame and removed again. The flood panel has a sealing element which can be inflated by means of air and which extends along the side edges and along a bottom edge of the flood panel.

U.S. Pat. No. 1,209,274 A discloses a locking unit for a sliding sash, comprising a pivotable hook at an upper edge of a lower window frame and an anchoring element on a corresponding frame element of an upper window frame. The hook is held hooked-in at the anchoring element by means of a spring. Further, means are provided to hold the hook in a position, pivoted against the spring force, after loosening of the anchoring element.

GB 668,560 A discloses a door lock comprising a locking bolt, which is to engage in a locking socket. The locking socket is formed from a tube, which is closed at one end and whose opening at the other end is made smaller by a welded-on annular plate. A plunger element, which is pressed by a spring against the annular plate, is arranged in the tube. Upon insertion of the locking bolt into the locking socket, the plunger element is moved by the locking bolt against the spring power in the tube.

The object of the invention is to provide a fixing device for a vertically movable closing element for the at least partial closing of an opening of a room.

The object is attained according to the invention by a fixing device for a vertically movable closing element for the at least partial closing of an opening of a room with the features of claim 1.

Advantageous embodiments of the invention are the subject of dependent claims.

A fixing device for a vertically movable closing element for the at least partial closing of an opening of a room, according to the invention, comprises for fixing of the closing element in a closed state at least one first fixing unit, arranged on the closing element, and an engaging unit, corresponding to the first fixing unit, in an opening bottom. Further, according to the invention, the fixing device for fixing of the closing element in the closed state comprises at least one second fixing unit, which is arranged on a guide, arranged to the side of the opening, for the closing element and has at least one tensioning hook, which in the closed state of the closing element can be latched in the closing element in the area of an upper side of the closing element, whereby the tensioning hook of the second fixing unit can be actuated pneumatically, hydraulically, and/or motor-driven, particularly is pivotable.

A closing element of this kind is used, for example, for sealing the room against water entering the room from outside, for example, in a flood event, or against an escape of liquids from the room into the environment, for example, in an accident in which escape of environmentally harmful substances and/or fire-fighting water from the room is to be prevented. For this reason, such closing elements are installed, for example, at openings of rooms which are used as storage rooms for environmentally harmful substances or as a production facility where substances of this kind are stored, processed, and/or produced.

Alternatively, the closing element in this way can also close an opening of a barrier and thereby a room behind the barrier. Barriers of this type are erected, for example, within a room as room dividers and extend, for example, from a room wall to an opposite room wall. The barrier divides the room into two spaces, which can be closed and sealed from each other by the barrier and the closing element. A barrier of this kind naturally can also be arranged outside a roof-covered space, for example, in a free area surrounded by side walls, whereby the barrier lies sealingly against the side walls. Two rooms sealable and separated from one another by the barrier and closing element are created in this way in the free area.

The closing element is to be secured in the closed state by means of the fixing device in such a way that opening of the closing element on its own is reliably prevented. To this end, the fixing device counters the forces which act on the closing element and could raise and/or deform the closing element and thereby could nullify the sealing of the opening of the room, which is brought about by the closing element in the closed state. The closing element can be pressed by means of the fixing device against the opening bottom and is to be secured against vertical movements. The fixing device represents a protection against lifting for the closing element. Further, the closing element is to be secured by means of the fixing device against horizontal movements and deformations and a resulting pulling out of the side guides.

The closing element can be fixed rigidly in the opening bottom by means of the first fixing unit and by means of the second fixing unit by engagement of the first fixing unit, arranged expediently on a lower edge of the closing element, in the engaging unit and by latching of the tensioning hook in the closing element, so that raising of the closing element is prevented, for example, because of floating and/or deformation of the closing element, for example, owing to loads, on one side, caused by flood water acting on one side on the closing element, fire-fighting water, and/or other liquids and possible objects floating therein and by wind loads acting on the closing element in storms.

Preferably, the fixing device has two second fixing units, in each case a second fixing unit on each side guide of the closing element, so that the closing element is optimally secured and braced by means of the tensioning hooks, which are made advantageously of metal, for example, of steel, and which latch into the closing element on both sides. Deformation of the closing element in particular, which would lead to pulling of the closing element out of the side guides, is also prevented as a result. The closing element is braced by the tensioning hooks on both sides in the direction of the side guides and retained in these.

To enable an optimal and very strong bracing of the closing element by each of the tensioning hooks, the closing element expediently has on the upper side for each tensioning hook a safety catch plate with a latching opening, in which the tensioning hook can be latched in the closed state of the closing element. Said safety catch plates, which are expediently made of metal, for example, of steel, bring about a reinforcement of the closing element and enable an optimal latching of the respective tensioning hook. A pulling of the latched tensioning hooks out of the closing element when forces act on said element is prevented by the safety catch plates.

The number of the first fixing units on the closing element and the engaging units corresponding to these is determined thereby advantageously by the design and intended use of the closing element, particularly by the longitudinal dimension thereof. The greater the longitudinal dimension of the closing element, particularly in the case of a small height of the closing element relative to the longitudinal dimension thereof, the more unstable the closing element, particularly in the case of horizontally acting forces, for example, due to liquid pressure of a liquid dammed by the closing element. Further, the stability of the closing element depends on the design and material thereof. Therefore, with relatively unstable closing elements, which, for example, have a long longitudinal dimension, i.e., a long width, preferably a plurality of first fixing units are arranged on the closing element distributed over a longitudinal dimension thereof and the associated corresponding engaging units are accordingly arranged distributed in the opening bottom.

The first fixing unit can be arranged on an outer side, on an inner side facing the room, or in the closing element. In the case of a plurality of first fixing units, these can be arranged accordingly on the outer side and/or on the inner side of the closing element and/or in the closing element.

Preferably, the first fixing unit comprises a preferably cone-shaped centering pin and/or at least one pivotable hook. The centering pin and the hook are each made, for example, of metal, for example, of steel. The centering pin can be inserted in the engaging unit during lowering of the closing element and secures the closing element particularly against deformations and/or movements in the horizontal direction.

Because of the cone-shaped, i.e., conical or frustoconical design of the centering pin, said pin can also be inserted securely in the engaging unit, preferably in a hollow space of the engaging unit, in already occurring horizontal deformations of the closing element during the lowering, for example, due to acting wind loads or even liquids flowing through the opening of the room, and thereby the closing element can be securely fixed, because the centering pin serves as a guiding device and during the insertion into the hollow space of the engaging unit due to the cone-shaped design also pulls an even somewhat vertically deformed closing element again into the intended position.

The closing element is to be hooked by means of the hook in the engaging unit and thereby in the opening bottom and thereby to be secured against vertical movement and/or deformation and preferably also against horizontal movements and/or deformations. Preferably, the hook or a plurality of hooks of this kind are disposed in the centering pin and are pivotable laterally out of said pin. The closing element, furthermore, is to be pulled by means of the hook(s) by the pivoting movement of the hook in the direction of the opening bottom and in this way pressed sealingly against said bottom.

In a preferred embodiment, the hook is disposed in the centering pin and can be pivoted out of said pin. To this end, the hook is disposed in the centering pin, made as a hollow part, and can be pivoted out of the pin through side openings, when the hook and the centering pin are disposed in the hollow space of the engaging unit, i.e., when the closing element has been lowered completely or at least almost completely. In this way, by means of the centering pin, which is used as a guiding means and accordingly aligns the closing element during the lowering, the hook can also be inserted securely and completely with the centering pin into the hollow space of the engaging unit and is pivotable therein, to hook the hook in the engaging unit and to fix the closing element thereby.

The hook is expediently pivotable pneumatically, hydraulically, motor-driven, and/or mechanically. In this regard, the pneumatic pivoting is to be preferred, because it can be carried out automatically, for example, in an automatic emergency closing of the closing element, and is simple to realize, for example, by a compressed air supply to the first fixing unit, which, for example, is connected to a compressor via a compressed air line and/or is connected, for example, to a compressed air system, which is already installed in many production facilities.

In this case, the first fixing unit is connected preferably via a pneumatic storage tank to the compressed air system or directly to the compressor, whereby the storage tank is permanently filled with an adequate compressed air supply under sufficient pressure, to enable by this compressed air supply alone an actuation of the first fixing units, i.e., a pivoting of the hook. This assures a reliable functioning, i.e., a reliable fixing of the closing element, in an accident as well in which the compressed air system and/or the compressor fail, for example, because of failure of the power supply.

To prevent an escape of compressed air from the pneumatic storage tank in such a failure of the compressor or of the compressed air system, a connection for a supply line between the compressed air system and/or the compressor and the pneumatic storage tank expediently has a check valve, which enables the flow of compressed air into the pneumatic storage tank, but prevents outflow from the pneumatic storage tank via the check valve. In this way, the pneumatic storage tank ensures the proper functioning of the fixing device at all times, particularly also, for example, in an accident with failure of the compressor or of the compressed air system, because sufficient compressed air is available at all times for actuating the fixing device.

After the hook(s) is/are pneumatically pivoted and hooked-in in this way, the closing element is secured by the hook(s) preferably in the non-pressurized state as well. In other words, the hook(s) does (do) not open with decreasing pressure, but only with renewed pressure application in the opposite direction, in order to pivot the hook(s) back. An unintentional loosening of the fixing of the closing element by the fixing device is reliably avoided as a result.

A so-called underbody clamp, for example, which is known from automobile manufacture and the sheet-metal-processing industry, can be used as the first fixing unit. Said underbody clamps have a pivotable hook or a pivotable double hook, i.e., two hooks pivotable in an opposite direction. In addition, said underbody clamps may also have a centering pin. In the embodiment with the centering pin, the hook(s) is/are disposed in the hollow centering pin and can be pivoted laterally out of said pin.

For the tensioning hook of the second fixing unit as well, the pneumatic actuation, particularly pivoting, of the tensioning hook of the second fixing unit is to be preferred, because it can be carried out automatically, for example, in an automatic emergency closing of the closing element, and is simple to realize, for example, by a compressed air supply to the second fixing unit, which, for example, is connected to a compressor via a compressed air line, for example, is connected to a compressed air system, which is already installed in many production facilities.

Here as well, the second fixing unit is connected preferably via a pneumatic storage tank to the compressed air system or directly to the compressor, whereby the storage tank is permanently filled with an adequate air supply under sufficient pressure, to enable by this compressed air supply alone an actuation of the second fixing unit, i.e., moving of the latch. This assures a reliable functioning, i.e., a reliable fixing of the closing element, also in an accident in which the compressed air system and/or the compressor fail, for example, because of failure of the power supply.

To prevent an escape of the compressed air from the pneumatic storage tank in such a failure of the compressor or of the compressed air system, a connection for a supply line between the compressed air system and/or the compressor and the pneumatic storage tank expediently has a check valve, which enables the flow of compressed air into the pneumatic storage tank here also, but prevents flow out of the pneumatic storage tank via the check valve. In this way, the pneumatic storage tank ensures the proper functioning of the fixing device at all times, particularly also, for example, in an accident with failure of the compressor or of the compressed air system, because sufficient compressed air is available at all times for actuating the fixing device.

The compressed air tank is expediently the same storage tank that is used for pivoting the hook(s). A coordinated actuation of the hook(s) of the first fixing unit(s) or the tensioning hook(s) of the second fixing unit(s) occurs expediently.

The actuation of the first fixing unit and/or the second fixing unit can preferably be triggered by a switch, which is switchable by the closing element when it lowers into the closed state. For example, the closing element actuates the switch during the last millimeters of the descent path, so that the latching of the fixing units occurs immediately after the complete lowering of the closing element.

The engaging unit preferably comprises a hollow space in the opening bottom, in which the first fixing unit can be inserted at least partially during a lowering of the closing element. More precisely stated, the centering pin and/or the hook of the first fixing unit can be inserted in the hollow space. In this way, the engaging unit is fully integrated into the opening bottom and does not interfere with the normal operation of the opening of the room; it can be driven over, for example, by vehicles without damage to the vehicles, the engaging unit, and the freight transported by vehicles, to transport materials in and out of the room. The first fixing unit projects downward at least partially, i.e., with the centering pin and/or the hook, beyond a lower edge of the closing element, in order to thereby enable an insertion into the hollow space during the lowering of the closing element.

Advantageously, the engaging unit has an indentation into which the hook can be hooked by pivoting. The indentation is formed, for example, by a bottom plate, which is arranged above the hollow space, preferably sunk into the opening bottom so that the surface of the bottom plate is at the height of a bottom surface, i.e., that the bottom plate is arranged not raised relative to the bottom surface. In this way, the bottom plate, which is made, for example, of metal, for example, of steel, can also be driven over by vehicles without damage to the vehicles, the transported freight, or the bottom plate.

The bottom plate has a through opening through which the centering pin and/or the hook can be inserted into the hollow space. A diameter of the through opening is made smaller than a diameter of the hollow space, so that the bottom plate forms an indentation. The hook is laterally pivotable in the hollow space, as a result of which it hooks into a bottom side of the bottom plate.

In an advantageous embodiment, the engaging unit has a sealing element for closing a hollow space opening of the hollow space in an open state of the closing element. As a result, in the open state of the closing element, the hollow space is sealed against entry of liquids and particularly against entry of dirt and other foreign bodies, which during a lowering of the closing element could impede or prevent entry of the centering pin and/or the hook and thereby a reliable fixing of the closing element. As a result, the proper functioning of the fixing unit is always assured especially after a very long lifetime thereof.

The sealing element is preferably arranged movable in the hollow space of the engaging unit. Especially preferably, a spring element is arranged under the sealing element in order to press the sealing element against the hollow space opening in the open state of the closing element. The sealing element is designed, for example, as a closed-cell rubber part, for example, of ethylene propylene diene rubber (EPDM), also called foam rubber, whose diameter is greater than a diameter of the hollow space opening.

When the bottom plate is arranged on the hollow space, the through opening of the bottom plate forms the hollow space opening to be sealed. In the open state of the closing element, the sealing element is pressed by means of the spring element, arranged thereunder, against the bottom side of the bottom plate, so that it closes and seals the hollow space opening formed by the through opening of the bottom plate. During the lowering of the closing element, the sealing element can be moved downward by the centering pin and/or the hook against the spring force of the spring element into the hollow space, so that the centering pin and/or the hook can enter the hollow space sufficiently deeply. In this case, the sealing element and the spring element can be used further for absorbing and cushioning the lowering movement of the closing element, in order to prevent during a rapid lowering movement of the closing element a forceful striking of the opening bottom and possibly resulting damage to the closing element, the opening bottom, and/or seals on the closing element and/or at the opening bottom.

Exemplary embodiments of the invention will be described in greater detail below with use of drawings.

Figure 2:
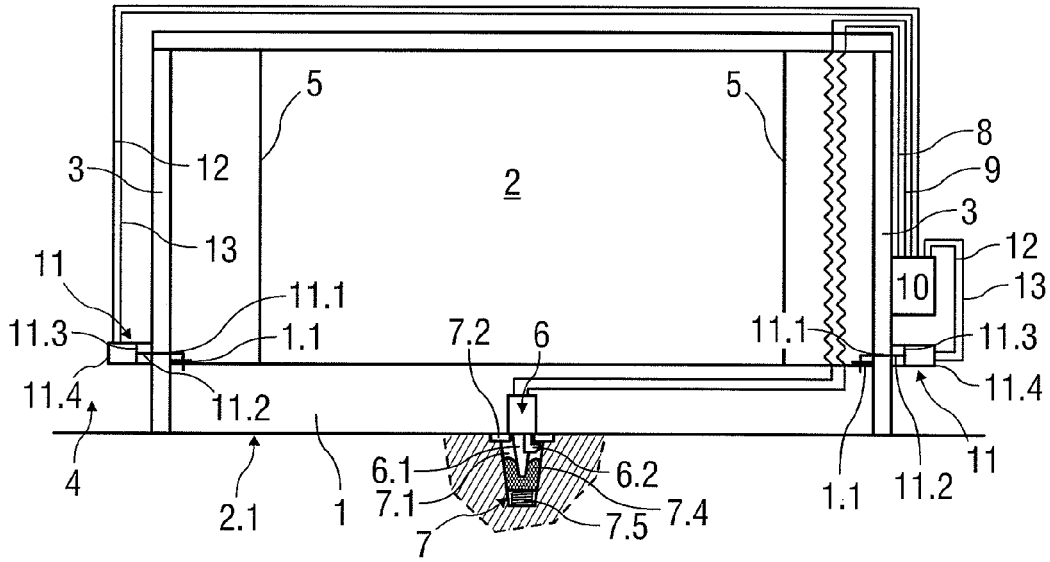

In the drawings:

FIG. 1 shows a schematic illustration of a closing element in the open state and a fixing device, and FIG. 2 shows a schematic illustration of a closing element in the closed state and a fixing device.

Parts corresponding to one another are provided with the same reference characters in all figures.

FIGS. 1 and 2 show a vertically movable closing element 1 for the at least partial closing of an opening 2 of a room. In this case, FIG. 1 shows closing element 1 in an open state in which it is located above opening 2 or in an upper area of opening 2. In this way, opening 2 of the room is open and freely accessible, for example, walkable or drivable with vehicles.

Closing element 1 is shown in a closed state in FIG. 2. It is lowered to an opening bottom 2.1 and fixed in this position. In this closed position, opening 2 is closed liquid-tight in the area of closing element 1 by said element. To this end, guides 3, arranged to the side of opening 2, for closing element 1 are attached sealingly to an outer wall 4 of the room at least to the height of an upper side of closing element 1 in the closed state; closing element 1 is arranged sealingly and guided in guides 3 at least in the closed state, and a seal is also arranged between a bottom side of closing element 1 and opening bottom 2.1 in the closed state of closing element 1; for example, it is attached to the bottom side of closing element 1.

A closing element 1 of this kind is used, for example, for sealing the room against water entering the room from outside, for example, in a flood event, or against an escape of liquids from the room into the environment, for example, in an accident in which an escape of environmentally harmful substances and/or fire-fighting water from the rooms is to be prevented. For this reason, closing elements 1 of this kind are installed, for example, at openings 2 of rooms which are used as storage rooms for environmentally harmful substances or as a production facility where substances of this kind are stored, processed, and/or produced.

If an event of this type occurs, i.e., for example, a flood or accident, closing element 1 is to be lowered and opening 2 of the room to be closed liquid-tight thereby, at least to a predetermined damming height. The damming height in this case is defined by a height of closing element 1.

Closing element 1 can be moved by a drive from the open state to the closed state and back. The drive is designed, for example, as a cable pull 5, of which only the cables connected to closing element 1 are shown here for the sake of clarity. Counterweights are arranged on this cable pull 5, for example, to compensate for a weight of closing element 1 and thereby to be able to move it with only a small additional expenditure of force. This additional expenditure of force can be realized, for example, manually, motor-driven, pneumatically, or hydraulically.

Closing element 1 has a fixing device to secure closing element 1 in the closed state in such a way that opening of closing element 1 on its own is reliably prevented. To this end, the fixing device counteracts forces which act on closing element 1 and could raise and/or deform closing element 1 and thereby could nullify the sealing of opening 2 of the room, which is brought about by closing element 1 in the closed state.

The fixing device in the example shown here has a first fixing unit 6, arranged on closing element 1, for fixing closing element 1 in the closed state. Furthermore, the fixing device comprises an engaging unit 7, corresponding to first fixing unit 6, in opening bottom 2.1. To be able to show clearly engaging unit 7, its parts, and its function in the figures, the opening bottom 2.1 and engaging unit 7 are shown cut schematically in the schematic illustrations of FIGS. 1 and 2, a cutting plane running vertically parallel to opening 2 of the room.

The first fixing unit 6 comprises a cone-shaped, i.e., conical or frustoconical centering pin 6.1 and a pivotable hook 6.2 disposed in centering pin 6.1. Centering pin 6.1 is designed as a hollow body, in which hook 6.2 is disposed, and has a side opening for hook 6.2, through which hook 6.2 can be pivoted pneumatically out of centering pin 6.1. To this end, hook 6.2 is placed pivotable in such a way and, for example, connected via piston rod (not shown) to a piston (not shown) of a pneumatic cylinder (not shown) in such a way that a linear movement of the piston in the pneumatic cylinder can be translated into the pivoting movement of hook 6.2. The first fixing unit 6 in other embodiments may also have, for example, two hooks 6.2 pivotable laterally out of centering pin 6.1 preferably in the opposite direction.

A so-called underbody clamp, for example, which is known from automobile manufacture and the sheet-metal-processing industry, can be used as such a first fixing unit 6. Said underbody clamps have a pivotable hook 6.2 or a pivotable double hook, i.e., two hooks 6.2 pivotable in an opposite direction. In addition, said underbody clamps may also have a centering pin 6.1. In the embodiment with centering pin 6.1, hook 6.2 or hooks 6.2 is or are disposed in centering pin 6.1 and can be pivoted laterally out of said pin. Underbody clamps of this kind are used, for example, for picking up, holding, and transporting metal sheets or parts by means of hook 6.2.

Engaging unit 7 comprises a hollow space 7.1 in opening bottom 2.1, in which the first fixing unit 6 can be inserted at least partially during the lowering of closing element 1. More precisely stated, hook 6.2 and centering pin 6.1 of the first fixing unit 6 can be inserted in hollow space 7.1, whereby during the insertion in hollow space 7.1 hook 6.2 is disposed still in its initial position in centering pin 6.1.

Engaging unit 7 is fully integrated into opening bottom 2.1 and does not interfere with the normal operation of opening 2 of the room; it can be driven over, for example, by vehicles without damage to the vehicles, engaging unit 7, and without damage to freight transported by the vehicles, to transport materials in and out of the room. The first fixing unit 6 is disposed in closing element 1, to be able to insert centering pin 6.1 and hook 6.2 in hollow space 7.1, in such a way that centering pin 6.1 and hook 6.2 disposed in it project downward beyond the bottom side of closing element 1.

Engaging unit 7 has an indentation in which hook 6.2, as shown in FIG. 2, can be hooked in by pivoting. The indentation is formed by a bottom plate 7.2, which is arranged above hollow space 7.1.

In this case, bottom plate 7.2, which, for example, is made of metal, for example, of steel, is sunk into opening bottom 2.1 so that a surface of bottom plate 7.2 is at the height of a bottom surface, i.e., that bottom plate 7.2 is arranged not raised relative to the bottom surface. In this way, bottom plate 7.2 can also be driven over by vehicles without damage to the vehicles, transported freight, or bottom plate 7.2.

Bottom plate 7.2 has a through opening 7.3, through which centering pin 6.1 and hook 6.2 disposed in it can be inserted into hollow space 7.1 during the lowering of closing element 1. A diameter of through opening 7.3 is made smaller than a diameter of hollow space 7.1 in the area directly under bottom plate 7.2, so that bottom plate 7.2 forms the indentation to which the pivoted-out hook 6.2 can hook. Hook 6.2 is pivotable laterally in hollow space 7.1, as a result of which it lies against a bottom side of bottom plate 7.2 and is hooked into bottom plate 7.2.

Engaging unit 7 has a sealing element 7.4 for closing a hollow space opening of hollow space 7.1 in an open state of closing element 1, as shown in FIG. 1. The hollow space opening is formed here by through opening 7.3 of bottom plate 7.2.

In the open state of closing element 1, hollow space 7.1 is sealed by sealing element 7.4 against entry of liquids and particularly against entry of dirt and other foreign bodies, which during a lowering of closing element 1 could impede or prevent entry of centering pin 6.1 and hook 6.2 disposed therein and thereby a reliable fixing of closing element 1. As a result, the proper functioning of the fixing unit is always assured especially after a very long lifetime thereof.

Sealing element 7.4 is arranged movable in hollow space 7.1 of engaging unit 7. A spring element 7.5 is arranged below sealing element 7.4, for example, in the form of a coil spring, to press sealing element 7.4 in the open state of closing element 1 against the hollow space opening formed by through opening 7.3 of bottom plate 7.2 and thereby to seal it.

Sealing element 7.4 is designed, for example, as a closed-cell rubber part, for example, of ethylene propylene diene rubber (EPDM), also called foam rubber, whose diameter is greater than the diameter of the hollow space opening, which is formed here by through opening 7.3 of bottom plate 7.2. In the open state of closing element 1, sealing element 7.4 is pressed by means of the spring element 7.5, arranged thereunder, against the bottom side of bottom plate 7.2, so that it closes and seals the hollow space opening formed by the through opening 7.3 of bottom plate 7.2.

During the lowering of closing element 1, sealing element 7.4 can be moved downward by centering pin 6.1 against the spring force of spring element 7.5 into hollow space 7.1, so that centering pin 6.1 and hook 6.2 can enter hollow space 7.1 sufficiently deeply. In this case, sealing element 7.4 and spring element 7.5 can be used further for absorbing and cushioning the lowering movement of closing element 1, in order to prevent a hard impact on opening bottom 2.1 during a rapid lowering movement of closing element 1 and a possibly resulting damage to closing element 1, opening bottom 2.1, and/or of seals on closing element 1 and/or at opening bottom 2.1.

If it is necessary to close opening 2 of the room liquid-tight at least in the lower area, closing element 1 can be lowered to opening bottom 2.1, as a result of which centering pin 6.1 with hook 6.2, disposed therein, during movement of sealing element 7.4 against the spring force of spring element 7.5 enters hollow space 7.1.

Centering pin 6.1 secures closing element 1 particularly against deformations and/or movements in the horizontal direction. Because of the cone-shaped design of centering pin 6.1, it can be inserted securely in hollow space 7.1 also in horizontal deformations of closing element 1, as already occur during the lowering, for example, due to acting wind loads or even liquids flowing through opening 2.1 of the room and thereby closing element 1 can be securely fixed.

If closing element 1 is completely lowered, hook 6.2 can be pivoted pneumatically laterally out of centering pin 6.1 and is pivotable under bottom plate 7.2, so that it hooks into bottom plate 7.2 and by the pneumatic pivoting movement in addition pulls closing element 1 downward and presses against opening bottom 2.1, so that the sealing of closing element 1 at opening bottom 2.1 is strengthened further. As a result, closing element 1 is to be fixed by means of hook 6.2 in engaging unit 7, more precisely, to be hooked into bottom plate 7.2 and thereby at opening bottom 2.1, and thereby to be secured against a vertical movement and/or deformation and preferably also against horizontal movements and/or deformations.

For the pneumatic pivoting of hook 6.2, the first fixing unit 6 is connected to a storage tank 10 for compressed air via a first compressed air feed line 8 and a first compressed air return line 9. This storage tank 10 is connected, for example, to a compressor or a compressed air system, not shown in greater detail, and filled permanently with an adequate compressed air supply under sufficient pressure, to enable by means of this compressed air supply alone actuation of the first fixing unit 6, i.e., pivoting of hook 6.2. This assures a reliable functioning, i.e., a reliable fixing of closing element 1, also in an accident in which the compressed air system and/or the compressor fail, for example, because of failure of the power supply.

To prevent an escape of compressed air from storage tank 10 in such a failure of the compressor or of the compressed air system, a connection (not shown in greater detail) for a supply line between the compressed air system and/or the compressor and storage tank 10 has a check valve, which enables the flow of compressed air into storage tank 10, but prevents out flow from storage tank 10 via the check valve. In this way, storage tank 10 ensures the proper functioning of the fixing device at all times, particularly also, for example, in an accident with failure of the compressor or of the compressed air system, because sufficient compressed air is available at all times for actuating the fixing device.

After hook 6.2 is pneumatically pivoted and hooked-in in this way, closing element 1 is secured by hook 6.2 in the non-pressurized state as well. In other words, hook 6.2 does not open with decreasing pressure, but only by a renewed pressure supply in the opposite direction, in order to pivot back hook 6.2. An unintentional loosening of the fixing of closing element 1 by the fixing device is reliably avoided as a result. For this reason, the first fixing unit 6 is connected to storage tank 10 via the first compressed air feed line 8 for the closing pivoting of hook 6.2 and connected to storage tank 10 via the first compressed air return line 9 for pivoting back of hook 6.2 and thereby for opening the fixing.

In addition, the fixing device comprises two second fixing units 11, which are arranged at guides 3 arranged to the side of opening 2 for closing element 1, one second fixing unit 11 on each side of opening 2. These second fixing units 11 each have a tensioning hook 11.1, which in the closed state of closing element 1 can be latched in closing element 1 in the area of an upper side of closing element 1. Tensioning hooks 11.1 in the state latched in closing element 1 are shown in FIG. 2. Tensioning hooks 11.1 are each coupled via another piston rod 11.2 to another piston 11.3 of another pneumatic cylinder 11.4 and are pivotable in this way. By means of tensioning hooks 11.1 latched in closing element 1 in the closed state, the closing element is also held in its position by these second fixing units 11 and secured particularly against vertical movements.

To enable a secure latching of tensioning hooks 11.1 in closing element 1, closing element 1 has on the upper side for each tensioning hook 11.1 a safety catch plate 1.1 with a latching opening, in which tensioning hook 11.1 latches in the closed state of closing element 1. Said safety catch plates 1.1, which are expediently made of metal, for example, of steel, bring about a reinforcement of closing element 1 and enable an optimal latching of the respective tensioning hook 11.1. A pulling of the latched tensioning hooks 11.1 out of closing element 1 when forces act on said element is prevented by safety catch plates 1.1.

Because of tensioning hooks 11.1 and safety catch plates 1.1, in analogy to the first fixing units 6, a horizontal and/or vertical movement and/or dynamic deformation of closing element 1 due to forces, acting on one side, by dammed liquids, wind load, or objects and furthermore a static deformation due to a length and weight of closing element 1 are reliably prevented. These safety catch plates 1.1 also take up, for example, forces from objects falling on closing element 1, for example, falling parts of buildings or trees. Deformation of closing element 1 and particularly a pulling out of side guides 3, with a U-shaped profile, which is brought about thereby, are prevented by tensioning hooks 11.1 hooked into safety catch plates 1.1.

For a pneumatic movement, i.e., for pivoting tensioning hooks 11.1, additional pneumatic cylinders 11.4 are also connected to storage tank 10, via second compressed air feed lines 12 and second compressed air return lines 13, and in this way can also be supplied with compressed air. As a result, tensioning hooks 11.1 can be pivoted in a similar way as hooks 6.2 of the first fixing unit 6, whereby here as well the pneumatic pivoting of tensioning hooks 11.1 is assured at all times by storage tank 10.

All fixing units 6, 11 can be triggered preferably by a switch, not shown in greater detail here, which is switchable by closing element 1, when it lowers into the closed state. For example, closing element 1 actuates the switch during the last millimeters of the descent path. The switch is to open, for example, a valve, not shown in greater detail, between the compressed air feed lines 8, 12 and storage tank 10, and fixing units 6, 11 can thereby be supplied with compressed air.

By latching of the first fixing unit 6 in engaging unit 7, i.e., by hooking of hook 6.2 in bottom plate 7.2 in the closed state of closing element 1 and further by the second fixing units 11, i.e., by the latching of tensioning hooks 11.1 in the upper side of closing element 1 in the closed state of closing element 1, closing element 1 can be fixed rigidly in opening bottom 2.1 by means of fixing units 6, 11 in the closed state, so that raising of closing element 1, for example, because of floating and/or deformation of closing element 1, for example, due to loads, on one side, flood water, fire-fighting water, and/or other liquids acting on closing element 1 on one side and possibly objects floating therein and to wind loads, acting on closing element 1, in storms is prevented.

In the exemplary embodiment shown here, only one first fixing unit 6 is arranged in the longitudinal direction in the center on an outer side of closing element 1. First fixing unit 6 can be arranged furthermore also on an inner side, facing the room, of closing element 1 or in closing element 1.

The number of the first fixing units 6 on closing element 1 and the engaging units 7 corresponding to these is determined advantageously by the design and intended use of closing element 1, particularly by the longitudinal dimension thereof. The greater the longitudinal dimension of closing element 1, particularly in the case of a small height of closing element 1 relative to the longitudinal dimension thereof, the more unstable closing element 1, particularly in the case of horizontally acting forces, for example, due to liquid pressure of a liquid dammed by closing element 1.

Furthermore, the stability of closing element 1 depends on the design and material thereof. Therefore, with relatively unstable closing elements 1, which, for example, have a long longitudinal dimension, i.e., a long width, preferably a plurality of first fixing units 6 are arranged on closing element 1 distributed over a longitudinal dimension thereof and the associated corresponding engaging units 7 are accordingly arranged distributed in opening bottom 2.1. With a plurality of such first fixing units 6, these can be arranged accordingly on the outer side and/or on the inner side of closing element 1 and/or in closing element 1.

In order to enable secure insertion of centering pin 6.1 and hooks 6.2 disposed therein through the through opening 7.3 in the respective bottom plate 7.2 in the respective hollow space 7.1 also in the case of a closing element 1 with a long longitudinal dimension and first fixing units 6 arranged off-center on closing element 1 in the longitudinal dimension also in the case of temperature-induced expansions of closing element 1, the through opening 7.3 particularly in the longitudinal direction of closing element 1 is made greater than a maximum diameter of centering pin 6.1. For example, through opening 7.3 is designed as a long hole, whose longitudinal dimension is directed in the longitudinal dimension of closing element 1.

As a result, a change in position of the respective centering pin 6.1 due to heat expansions of closing element 1, on which it is arranged, can be compensated and centering pin 6.1 and hook 6.2 disposed in it can be inserted securely through the through opening 7.3 of bottom plate 7.2 into hollow space 7.1 over a very broad temperature range. Such temperature-induced expansions can assume a considerable extent in a very long longitudinal dimension of closing element 1, particularly when outer wall 4 of the room is an outer wall of a building and closing element 1 is therefore exposed both to very low winter temperatures and very high summer temperatures and to still higher temperatures in the case of an accident with fire development.

LIST OF REFERENCE CHARACTERS 1 closing element
1.1 safety catch plate
2 opening
2.1 opening bottom
3 guide
4 outer wall
5 cable pull
6 first fixing unit
6.1 centering pin
6.2 hook
7 engaging unit
7.1 hollow space
7.2 bottom plate
7.3 through opening
7.4 sealing element
7.5 spring element
8 first compressed air feed line
9 first compressed air return line

10 storage tank
11 second fixing unit
11.1 tensioning hook
11.2 additional piston rod
11.3 additional piston
11.4 additional pneumatic cylinder
12 second compressed air feed line
13 second compressed air return line

The invention claimed is:

1. A fixing device for a vertically movable closing element for the at least partial closing of an opening of a room, comprising, for fixing of the closing element in a closed state:

at least one first fixing unit, arranged on the closing element, an engaging unit, corresponding to the first fixing unit, in an opening bottom of the opening, and at least one second fixing unit arranged on a guide, the guide being arranged to the side of the opening, for the closing element and the at least one second fixing unit having at least one tensioning hook, which in the closed state of the closing element, is latched into the closing element in the area of an upper side of the closing element, wherein the tensioning hook of the at least one second fixing unit is pivotable and is actuated pneumatically, hydraulically, and/or motor-driven, wherein the at least one first fixing unit comprises a centering pin and at least one pivotable hook, and wherein the at least one pivotable hook is disposed inside of the centering pin and is pivoted out of the centering pin.

2. The fixing device according to claim 1, wherein the closing element has on the upper side a safety catch plate with a latching opening, in which the tensioning hook is latched in the closed state of the closing element.

3. The fixing device according to claim 2, wherein the safety catch plate is made of metal.

4. The fixing device according to claim 1, wherein the at least one pivotable hook is pivotable pneumatically, hydraulically, motor-driven, and/or mechanically.

5. The fixing device according to claim 1, wherein the engaging unit comprises a hollow space in the opening bottom, in which the at least one first fixing unit is inserted at least partially during a lowering of the closing element.

6. The fixing device according to claim 1, wherein the engaging unit has an indentation into which the at least one pivotable hook is hooked by pivoting.

7. The fixing device according to claim 6, wherein the indentation is formed by a bottom plate, which is sunk into the opening bottom.

8. A fixing device for a vertically movable closing element for the at least partial closing of an opening of a room, comprising, for fixing of the closing element in a closed state:

at least one first fixing unit, arranged on the closing element, an engaging unit, corresponding to the first fixing unit, in an opening bottom of the opening, and at least one second fixing unit arranged on a guide, the guide being arranged to the side of the opening, for the closing element and the at least one second fixing unit having at least one tensioning hook, which in the closed state of the closing element, is latched into the closing element in the area of an upper side of the closing element, wherein the tensioning hook of the at least one second fixing unit is pivotable and is actuated pneumatically, hydraulically, and/or motor-driven, wherein the at least one first fixing unit comprises a centering pin and at least one pivotable hook, wherein the engaging unit has an indentation into which the at least one pivotable hook is hooked by pivoting, wherein the indentation is formed by a bottom plate, which is sunk into the opening bottom, and wherein the bottom plate has a through opening through which the centering pin and the at least one pivotable hook is inserted into the hollow space, whereby a diameter of the through opening is smaller than a diameter of the hollow space.

9. The fixing device according to claim 5, wherein the engaging unit has a sealing element for closing a hollow space opening of the hollow space in an open state of the closing element.

10. The fixing device according to claim 9, wherein the sealing element is arranged movable in the hollow space of the engaging unit and a spring element is arranged under the sealing element in order to press the sealing element against the hollow space opening in the open state of the closing element.

11. The fixing device according to claim 9, wherein the at least one first fixing unit and/or the at least one second fixing unit is/are connected to a pneumatic storage tank that provides compressed air to drive the at least one first fixing unit and/or the at least one second fixing unit.

12. The fixing device according to claim 11, wherein the actuation of the at least one first fixing unit and/or the at least one second fixing unit is triggered by a switch, which is switchable by the closing element when it lowers into the closed state.

13. The fixing device according to claim 12, comprising two second fixing units, whereby a second fixing unit is arranged on both side guides of the closing element.

14. A fixing device for a vertically movable closing element for the at least partial closing of an opening, comprising:

at least one first fixing unit, arranged on the closing element, an engaging unit, corresponding to the first fixing unit, in an opening bottom of the opening, and at least one second fixing unit arranged on a guide, the guide being arranged to the side of the opening, for the closing element and the at least one second fixing unit having at least one tensioning hook, which in the closed state of the closing element, is latched into the closing element in the area of lower an upper side of the closing element, wherein the at least one first fixing unit comprises a centering pin and at least one pivotable hook, and wherein the at least one pivotable hook is disposed inside of the centering pin and is pivoted out of the centering pin.

15. The fixing device according to claim 14, wherein the engaging unit comprises a hollow space in the opening bottom, in which the centering pin and the at least one pivotable hook are inserted at least partially during a lowering of the closing element.

* * * * *